US005289780A

United States Patent [19]

Bounds

[11] Patent Number: 5,289,780

[45] Date of Patent: Mar. 1, 1994

[54] MATERIAL HANDLING RAILROAD FREIGHTCAR-MOUNTED GANTRY AND CRANE WITH TOPPLING PREVENTION AND SUPPLEMENTAL SUPPORT UPON DERAILMENT

[75] Inventor: Ivan E. Bounds, St. Joseph, Mo.

[73] Assignee: Herzog Contracting Corp., St. Joseph, Mo.

[21] Appl. No.: 985,022

[22] Filed: Dec. 3, 1992

[51] Int. Cl.[5] ..... B61F 9/00

[52] U.S. Cl. ..... 104/242; 104/248; 105/163.1; 105/180; 212/219

[58] Field of Search ..... 104/2, 242, 243, 248; 105/163.1, 163.2, 180; 212/189, 219; 188/1.12, 2 D, 29, 57, 60, 106.7, 107, 382

[56] References Cited

U.S. PATENT DOCUMENTS

| | | | |
|---|---|---|---|
| 604,513 | 5/1898 | Beasley | 104/248 |
| 822,837 | 6/1906 | Fitzgibbons | 212/219 X |
| 2,156,424 | 5/1939 | Barnard | 212/219 X |
| 3,414,143 | 12/1968 | Scott | 212/219 X |
| 3,784,035 | 1/1974 | Dunbar | 212/189 X |
| 4,046,077 | 9/1977 | Theurer et al. | 104/2 |
| 4,152,990 | 5/1979 | Theurer et al. | 104/6 |
| 4,261,264 | 4/1981 | Theurer et al. | 104/2 X |
| 4,542,697 | 3/1983 | Cicin-Sain | 104/2 |
| 4,794,861 | 1/1989 | Theurer et al. | 104/2 |
| 4,829,907 | 5/1989 | Theurer et al. | 104/5 |
| 4,911,599 | 3/1990 | Theurer et al. | 414/339 |
| 5,115,539 | 5/1922 | Lee | 188/1.12 |

FOREIGN PATENT DOCUMENTS

| | | | |
|---|---|---|---|
| 1242993 | 10/1988 | Canada | 212/189 |
| 942413 | 3/1956 | Fed. Rep. of Germany | 104/248 |
| 1306892 | 4/1987 | U.S.S.R. | 104/242 |

OTHER PUBLICATIONS

M4 Holdings Ltd (Material Handling Flat Car Gantry) Information Brochure.

*Primary Examiner*—Robert J. Oberleitner
*Assistant Examiner*—S. Joseph Morano
*Attorney, Agent, or Firm*—Litman, McMahon & Brown

[57] ABSTRACT

A gantry adapted for operation along rails attached to the top of a railroad car includes two pairs of wheels, each pair operating on a respective rail. A base support member is positioned above the rail and between the wheels on each side of the gantry. Should one end of the gantry be inadvertently driven off of the rails, the base support members engage the rails to prevent the gantry from toppling off of the railroad car. In addition, a safety rail is positioned inside of and above each rail and a plurality of J-hooks are attached to the inside of each base support member to engage the safety rails and prevent the gantry from tipping from side-to-side. All four wheels are independently driven and the gantry is adapted to support a commercially available crane, the position of which can be vertically adjusted via spacers. A number of other safety features are included.

14 Claims, 2 Drawing Sheets

MATERIAL HANDLING RAILROAD FREIGHTCAR-MOUNTED GANTRY AND CRANE WITH TOPPLING PREVENTION AND SUPPLEMENTAL SUPPORT UPON DERAILMENT

BACKGROUND OF THE INVENTION

1. Field of the Invention

This invention is directed to a gantry with an attached crane mounted on a railroad freightcar and more particularly to a gantry and crane designed for handling large and bulky materials such as railroad tie bundles, rail culverts, poles, switches, etc. and loading or unloading them from the freightcar on which it is mounted or surrounding freightcars, and an apparatus and method for safely retaining the gantry on the freightcar.

2. Description of the Related Art

In modern railroad operations, it is common for railroad tracks, including rails, ties and ballast, to be replaced in large sections. This is often accomplished by special high capacity track renewal trains which include a number of railroad freightcars, each of which can accommodate large numbers of new ties, rails, culverts, etc. At least some of the freightcars in the train are equipped with a special pair of rails permanently affixed to the top thereof, and extending along each side of the freightcar. The special renewal train has at least one traveling gantry which can operate along the freightcar rails to transport material to or from the associated or surrounding freightcars. The gantry or gantries can be moved from car to car within the train as needed.

Such freightcar mounted gantries have supported both vertical hoists for lifting and transporting material along the cars, and power-driven cranes with extendable booms designed for considerable reach away from the cars.

A potentially dangerous problem associated with such prior art gantries, and particularly those supporting cranes, has been the tendency for tipping from side-to-side, given the necessarily high center of gravity of the crane and the large moment arm presented by the boom. In addition, operators of such gantries have had a tendency to drive them completely off of the rails on the freightcar, resulting in overturned and damaged gantries, and consequent danger to the operator and surrounding personnel.

It is clear, then, that a real need exists for a freightcar mounted gantry and crane which is designed to prevent these problems. Such a gantry should resist tipping and, in the event that either end is driven past the freightcar-mounted rails, the gantry should be prevented from overturning or otherwise falling off of the freightcar. For reasons of economy, such a gantry should be capable of accepting existing commercially available cranes.

SUMMARY OF THE INVENTION

In the practice of the present invention, a railroad freightcar-mounted gantry is designed to accept a commercially available crane. The gantry, which is designed to operate on dedicated rails extending along the outside edges of the freightcar, comprises a platform with four, separately drivable wheels. Extending above each rail and between the wheels on each side of the gantry is an elongated base support member which normally rides just above the rails. In the event that the wheels on either end of the gantry are accidentally driven past the end of the rails, the base support members drop down onto the top of the corresponding rails to support the gantry and prevent it from overturning and/or toppling off of the freightcar. Placed inside of the rails on each side of the freightcar is a corresponding pair of elevated safety rails. Each safety rail is attached to the corresponding rail via a plurality of welded support members. One or more J-hooks are rigidly attached to the gantry on the inside of each of the elongate base support members. The hook end of each J-hook overlaps a safety rail to prevent the gantry from tipping from side-to-side due to motion of the train or operation of the crane boom. Since all four wheels are powered, in the event that one end of the gantry is driven off of the rails, the wheels on the other end can be driven in reverse to pull the gantry back onto the rails. Other safety features include a separate parking brake for each wheel, and a wheel design with protected bearings and a covered drive mechanism.

OBJECTS AND ADVANTAGES OF THE INVENTION

The principle objects and advantages of the present invention include: to provide a railroad freightcar-mounted gantry and crane; to provide such a gantry and crane with four wheels designed to operate along rails mounted on the freightcar, with each wheel separately drivable; to provide such a gantry and crane in which an elongate base support member extends between the wheels on each side of the gantry to support the gantry in the event that the wheels on either end are inadvertently driven off of the rails; to provide such a gantry and crane in which one or more J-hooks attached to the base support members are positioned to engage a pair of elevated safety rails on the car to prevent the gantry from tipping from side-to-side; to provide such a gantry and crane which is designed for lifting and moving bulky and heavy objects safely and securely; to provide such a gantry and crane in which the wheels each include protected bearings and covered drive mechanisms; to provide such a gantry to which a commercially available crane can be attached; to provide a method of reliably securing a gantry to rails on a railroad freightcar which prevents the gantry from falling off of the end of the rails or tipping side-to-side; and to provide such a gantry and crane which is particularly well suited for its intended use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

2 and with portions of the safety rail broken away to illustrate detail thereof.

Figure 4:
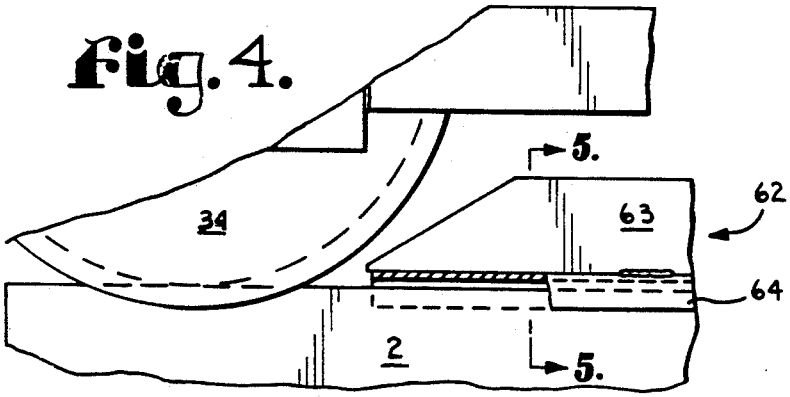

FIG. 4 is an enlarged, fragmentary view of a gantry wheel and base support member with the base support member partially broken away to illustrate the position of the base support member relative to the rail when the wheel is positioned on the rail.

Figure 5:
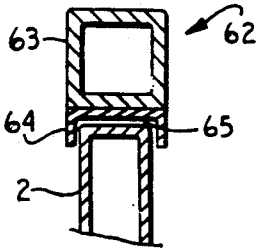

FIG. 5 is an enlarged, fragmentary, cross-sectional view of the gantry, taken along line 5—5 of FIG. 4, and illustrating the position of the base support member relative to the rail when the wheel is positioned on the rail.

Figure 6:
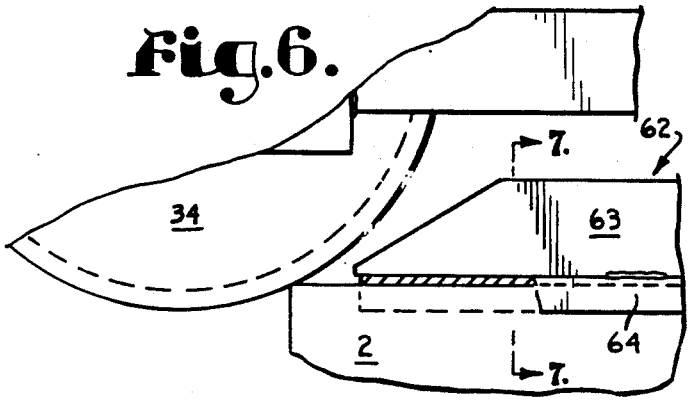

FIG. 6 is an enlarged, fragmentary view of a gantry wheel and base support member with the base support member partially broken away to illustrate the position of the base support member relative to the rail when the wheel has been driven off of the end of the rail.

Figure 7:
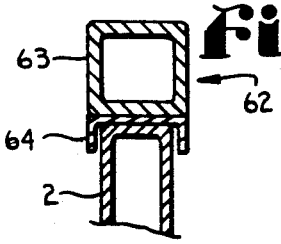

FIG. 7 is an enlarged, fragmentary, cross-sectional view of the gantry, taken along line 7—7 of FIG. 6, and illustrating the position of the base support member relative to the rail when the wheel has been driven off of the end of the rail.

Figure 1:
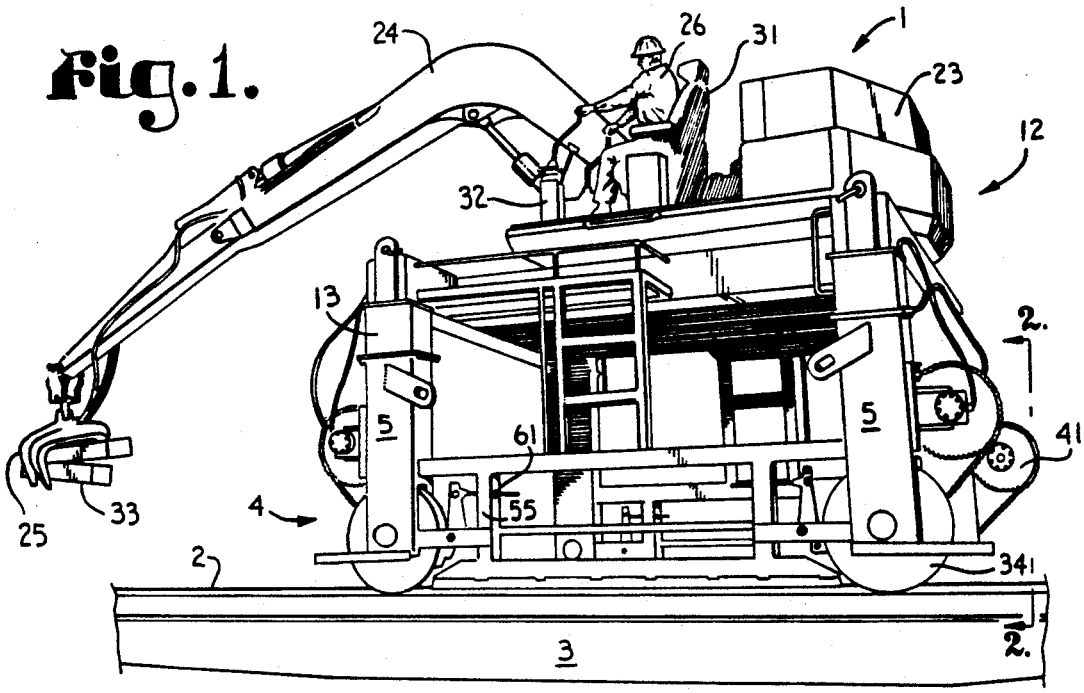
FIG. 1 is a perspective view of a gantry and crane in accordance with the invention, shown mounted on a railroad flatcar.
Figure 8:
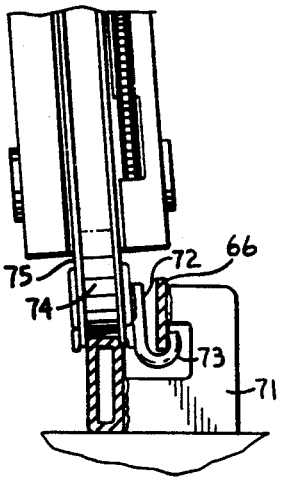

FIG. 8 is an enlarged and fragmentary cross-sectional view of the gantry, taken along line 2—2 of FIG. 1 and illustrating the J-hook engaging the safety rail to prevent the gantry from tipping side-to-side.

Figure 9:
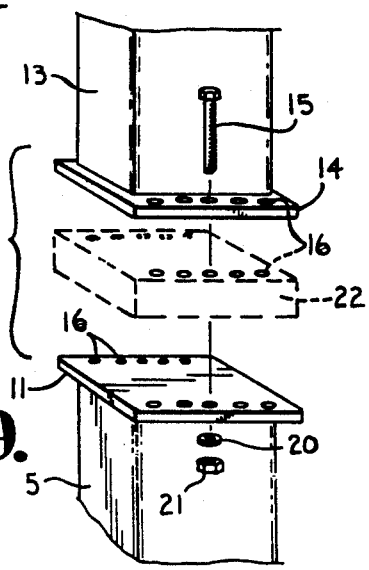

FIG. 9 is an enlarged and fragmentary exploded view of a gantry and a crane support post with an optional spacer illustrated in phantom lines.

DETAILED DESCRIPTION OF THE INVENTION

I. Introduction and Environment

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail the reference numeral 1 in FIG. 1 generally designates a gantry and crane assembly adapted to operate along a pair of rails 2 positioned atop a railroad flatcar 3. A gantry 4 comprises four vertically oriented supports 5, each terminating in a flange 11. A crane 12, which can be a conventional, commercially available crane, also includes four mating vertical supports 13, each terminating in a flange 14. Referring to FIG. 9, the flanges 11 and 14 are connected together via a plurality of bolts 15 extending through cooperating bores 16 in the flanges 11 and 14 and secured by washers 20 and nuts 21. One or more spacers 22 can be provided between the flanges 11 and 14 to vertically adjust the crane 12. The crane 12 includes a conventional cab 23, a hydraulically operated boom 24 and an attached claw 25 for grasping and releasing materials. An operator 26 is positioned in a seat 31 with a control station 32 adjacent thereto. In a conventional fashion, the operator 26 can swivel the cab 23, control the boom 24 and the claw 25, and can operate the gantry 2 via the control station 32. The claw 25 is shown grasping a number of railroad ties 33 such as might be found on a track renewal train, for example.

II. Gantry

The gantry 4 will now be described, with reference to FIGS. 1-9. Referring to FIG. 1, the gantry 4 comprises four wheels 34, each of which supports one of the vertical columns 5. Each wheel 34 is independently drivable via a motor 35, a motor sprocket 41, a drive chain 42, and a wheel sprocket 43. Dynamic braking on each wheel 34 is via a conventional individual hydraulic brake system (not shown) which is enclosed and protected. Static braking, as when the railroad flatcar 3 is to be moved with the gantry and crane assembly 1 atop thereof, is accomplished via individual, hand-operated parking brakes 44. Each parking brake 44 includes a brake pad 51 pivotally connected to a lever arm 52 which is connected to pivot about a horizontal frame member 53. An adjustable linkage 54 extends through a corresponding vertical frame member 55 (FIG. 1), with an adjustment nut 61 adapted for tightening or releasing the linkage 54 and thus applying or releasing the parking brake 44.

Positioned above the rails 2 and between the wheels 34 on each side of the gantry 4 is a base support member 62. Each base support member 62 is constructed from a tubular steel member 63 and an inverted channel member 64. The channel members 64 are sized to extend over both sides of the rails 2, as shown in FIG. 5. Referring to FIGS. 4 and 5, the base support members 62 are normally positioned just above the rails 2, leaving a gap 65, when the wheels 34 are positioned on top of the rails 2. In the event that the operator 26 inadvertently drives the wheels 34 on one end of the gantry 4 off of the rails 2, the channel members 64 of the base support members 62 will fall onto the rails 2, eliminating the gap 65, as shown on FIGS. 6 and 7, supporting the gantry 4 to prevent it from falling off of the end of the rails 2 and/or toppling off of the railroad flatcar 3.

Figure 2:
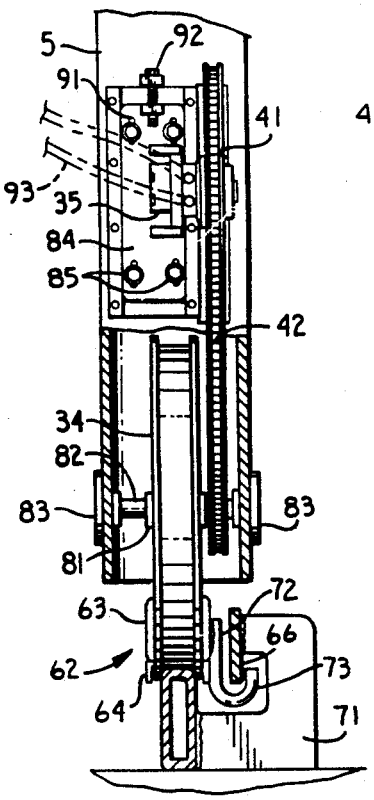
FIG. 2 is an enlarged, fragmentary and cross-sectional view of the gantry, taken along line 2—2 of FIG. 1, with portions thereof broken away to illustrate a wheel drive mechanism, a J-hook and a safety rail.
Figure 3:
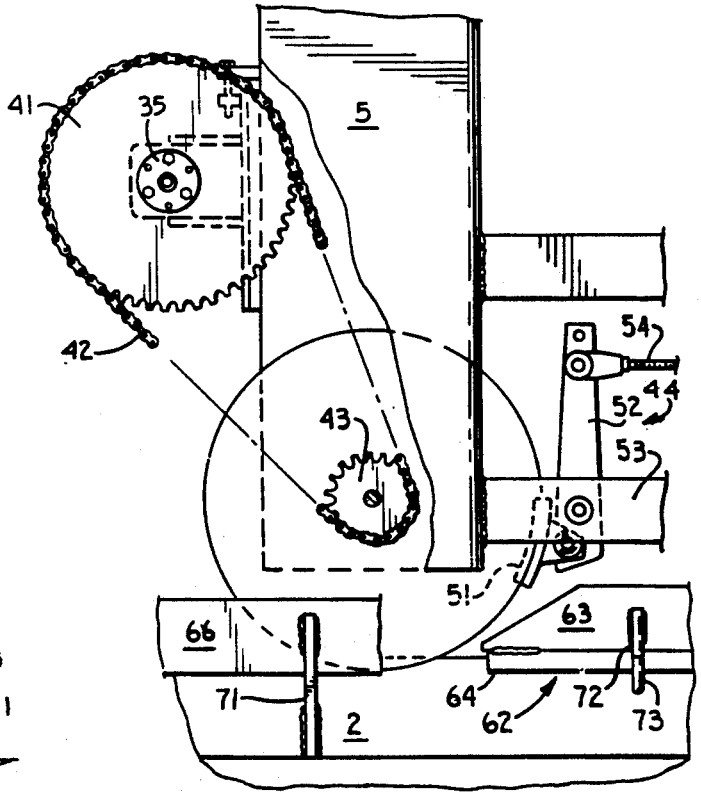
FIG. 3 is an enlarged, fragmentary and cross-sectional view of the gantry, taken along line 3—3 of FIG.

Referring to FIGS. 2 and 8, a safety rail 66 is attached to each rail 2 via a plurality of welded supports 71. A plurality of J-hooks 72 are welded or otherwise attached to the inside of the base members 62, with a hook end 73 of the J-hook 72 extending partially around the corresponding safety rail 66. Under normal conditions, the J-hooks 72 do not contact the safety rail 66, as shown in FIG. 2. In the event that the center of gravity of the gantry 4 is shifted significantly, as, for example when the boom 24 of the crane 12 is extended directly to the side with a heavy load, the gantry 4 will lean toward the boom 24. In such an event, the J-hooks 72 engage the safety rails 66, as shown in FIG. 8, and prevent the gantry 4 from tipping side-to-side.

Referring to FIG. 2, the drive mechanism for each wheel 34 is more particularly illustrated. Each wheel 34 resembles a conventional railroad wheel with an inner cylinder 74 riding on the rails 2 and sandwiched between a pair of outer plates 75. The wheels 34 rotate about enclosed bearing members 81 attached to axles 82, which are, in turn, attached to the vertical support posts 5 via opposing plates 83. The motors 35 and the motor sprockets 41 are attached to the vertical posts 5 via a mounting plate 84 secured by a plurality of bolts 85. Each bolt 85 is attached through a slot 91 which allows the support to be moved up and down via an adjustment screw 92 to adjust the tension of the chain 42. Each of the motors 35 are independently controllable in either direction by the operator 26 via cables 93, thus permitting a great deal of flexibility in driving the gantry 4. The motors 35 can be either electric or hydraulic.

III. Operation

The operation of the gantry and crane assembly 1 will now be described with reference to FIGS. 1-9. The flatcar 3 is one of a plurality of such cars on a train. The train can be a special track renewal train loaded with railroad ties, rails, culverts, ballast, etc. The gantry and crane assemblies 1 can be moved from car to car within the train to offload new track material and/or to load old track material.

Each gantry 4 is selectively movable forward and backward via the four, independently driven wheels 34. The concealed bearings 81 are virtually maintenance free and the placement of the wheel sprocket 43 on the inside of each wheel 43 adds to the safety of the gantry 4. The gantry 4 is securely held on the rails 2, even with the crane 12 operating, and even should the operator 26 inadvertently drive it off of the ends of the rails 2, by the J-hooks 72 cooperating with the safety rails 66, and by the base support members 62 overlying the rails 2, respectively.

In a preferred embodiment of the invention, the crane is a Komatsu PC80 removed from its drive tracks and equipped with the crane support posts 13 and flanges 14.

While the railroad car 3 is depicted herein as a flatcar, it should be clear that the rails 2 can be positioned on the bed of any suitable railroad freightcar, and, alternatively, can be placed on top of a box car with a strengthened frame.

It is to be understood that while certain forms of the present invention have been illustrated and described herein, it is not to be limited to the specific forms or arrangement of parts described and shown.

What is claimed and desired to be secured by Letters Patent is as follows:

1. A gantry apparatus adapted for movement along a pair of rails, comprising:
(a) a pair of wheels on each side of the gantry, each pair of said wheels being sized and spaced to operate on a respective one of said rails; and
(b) a pair of base support means positioned between respective wheels on each side of the gantry and suspended above the corresponding rail, each said base support means being positioned to drop into contact with said corresponding rail to support the gantry should the wheels on either end be driven off of the end of the rails.

2. An apparatus as in claim 1, wherein:
(a) said rails are positioned on a railroad car.

3. An apparatus as in claim 2, wherein said railroad car further comprises:
(a) at least one safety rail means positioned inside of said rails, said safety rail being attached to and extending downward from a support, leaving a space between the rail and the support; and
(b) said gantry comprises a J-hook extending around the bottom of the safety rail with an end portion of the J-hook extending upward into said space, said J-hook being adapted to engage said safety rail when said gantry tips from side to side to prevent the gantry from toppling.

4. An apparatus as in claim 3, wherein:
(a) there are two of said safety rails, one positioned inside and above each of said rails; and
(b) there are at least two of said J-hooks, one attached to each of said base support means.

5. An apparatus as in claim 2, wherein:
(a) said gantry is adapted to support a crane.

6. An apparatus as in claim 5, wherein:
(a) said gantry includes a plurality of vertically oriented supports, each of which terminates in a flange which is adapted to mate with a similar flange on said crane; and
(b) said crane is adjustable vertically by adding or removing spacers between said flanges.

7. An apparatus as in claim 2, wherein:
(a) each of said wheels includes an independent driving means.

8. An apparatus as in claim 7, wherein:
(a) each of said driving means is positioned adjacent the associated wheel, with each drive means comprising a motor, a motor sprocket, a wheel sprocket on the associated wheel, and a drive chain connecting said sprockets.

9. An apparatus as in claim 2, wherein:
(a) each of said wheels includes an independent braking means.

10. A gantry apparatus adapted for movement along a pair of rails positioned on a railroad car, said railroad car also including at least one safety rail, said safety rail being attached to and extending downward from a support, leaving a space between the rail and the support positioned inside of said rails, the apparatus comprising:
(a) a pair of wheels on each side of the gantry, each pair of said wheels being sized and spaced to operate on a respective one of said rails; and
(b) a J-hook means connected to said gantry, said J-hook extending around the bottom of the safety rail with an end portion of the J-hook extending upward into said space, said J-hook being adapted to engage said safety rail when said gantry tips from side to side to prevent the gantry from toppling.

11. A gantry apparatus adapted for movement along a pair of rails positioned on a railroad car, said car also including at least one safety rail means positioned inside of said rails, the apparatus comprising:
(a) a pair of wheels on each side of the gantry, each pair of said wheels being sized and spaced to operate on a respective one of said rails, with each of said wheels being independently drivable;
(b) a pair of base support means positioned between respective wheels on each side of the gantry and suspended above the corresponding rail, each said base support means being positioned to drop into contact with said corresponding rail to support the gantry should the wheels on either end be driven off of the end of the rails;
(c) a J-hook which is adapted to engage said safety rail to prevent the gantry from toppling side-to-side; and
(d) a plurality of vertically oriented supports, each of which terminates in a flange which is adapted to mate with a similar flange on a crane.

12. An apparatus as in claim 11, wherein:

(a) there are two of said safety rails, one positioned inside and above each of said rails; and (b) there are at least two of said J-hooks, one attached to the inside of each of said base support means.

13. A method of preventing a gantry operating on pair of rails from toppling side-to-side, said method including the steps of:

(a) positioning a safety rail inside of at least one of said rails, said safety rail being attached to and extending downward from a support, leaving a space between the rail and the support; and (b) attaching a J-hook to said gantry in a position wherein said J-hook extends around the bottom of the safety rail with an end portion of the J-hook extending upward into said space, said J-hook being adapted to engage said safety rail when said gantry tips from side-to-side to prevent the gantry from toppling.

14. A method of preventing a gantry equipped with two pair of wheels operating on a short pair of rails from falling off of either end of the rails, said method including the step of:

(a) placing a pair of base support members suspended above respective ones of said rails and between respective wheels on either side of the gantry, each said base support means being positioned to drop into contact with said respective rail to support the gantry should the wheels on either end be driven off of the end of the rails.

* * * * *